United States Patent [19]

Schlau et al.

[11] 4,120,190

[45] Oct. 17, 1978

[54] CRAFT DEVICE FOR DECORATIVELY DEFORMING METAL CANS AND THE LIKE

[75] Inventors: Floyd E. Schlau, East Greenwich, R.I.; Howard J. Morrison, Deerfield, Ill.

[73] Assignee: Marvin Glass & Associates, Chicago, Ill.

[21] Appl. No.: 767,432

[22] Filed: Feb. 14, 1977

[51] Int. Cl.[2] ..... B21J 13/08

[52] U.S. Cl. ..... 72/458; 72/461; 113/116 Z; 100/DIG. 2

[58] Field of Search ..... 72/435, 450, 455, 458, 72/459, 461, 447; 29/DIG. 30, 267; 113/116 Z; 100/233, DIG. 2; 269/237, 238, 239; 83/612, 562

[56] References Cited

U.S. PATENT DOCUMENTS

| | | | |
|---|---|---|---|
| 1,350,904 | 8/1920 | Walters | 72/447 |
| 2,466,907 | 4/1949 | Nadolny et al. | 100/DIG. 2 |
| 3,071,368 | 1/1963 | Harding | 269/239 X |
| 3,111,157 | 11/1963 | Henry | 72/450 X |
| 3,776,129 | 12/1973 | Carlson | 100/DIG. 2 |
| 3,948,164 | 4/1976 | Pobuda | 100/DIG. 2 |

*Primary Examiner*—Leon Gilden

*Attorney, Agent, or Firm*—Mason, Kolehmainen, Rathburn & Wyss

[57] ABSTRACT

A can decorating and deforming craft device includes a base for supporting a can laid on its side and at least one can deforming element mounted for selective deforming engagement with an upwardly facing surface of a can placed in position on the base. A lever extends longitudinally of the can and is manually pivotable toward and away from the can to bring one or more of the detachably mounted can deforming elements into surface deforming engagement with the can. Additionally, one or more side deforming elements may be detachably interlocked with the base to provide for selective deformation of the can sides in addition to the deformation of an upwardly facing surface of the can. The can may be deformed into a wide variety of different shapes and decorative paints, decals and the like may be applied to the deformed can to provide a design resembling the face of a clown or the like as an example.

12 Claims, 10 Drawing Figures

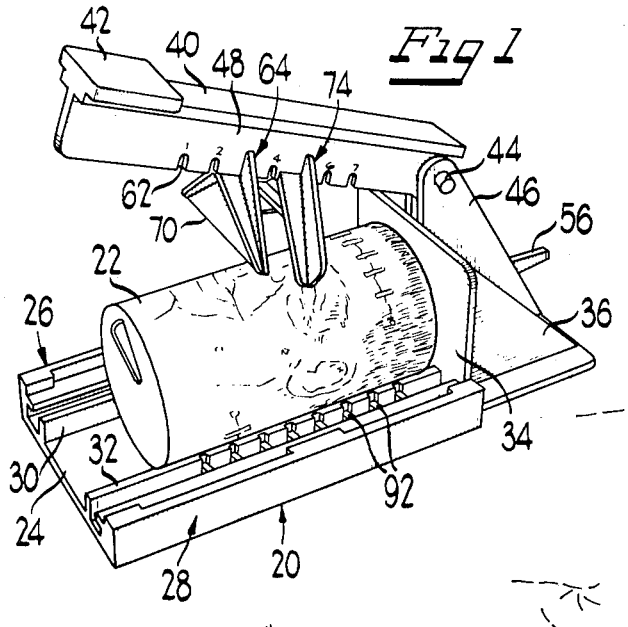
Fig 1
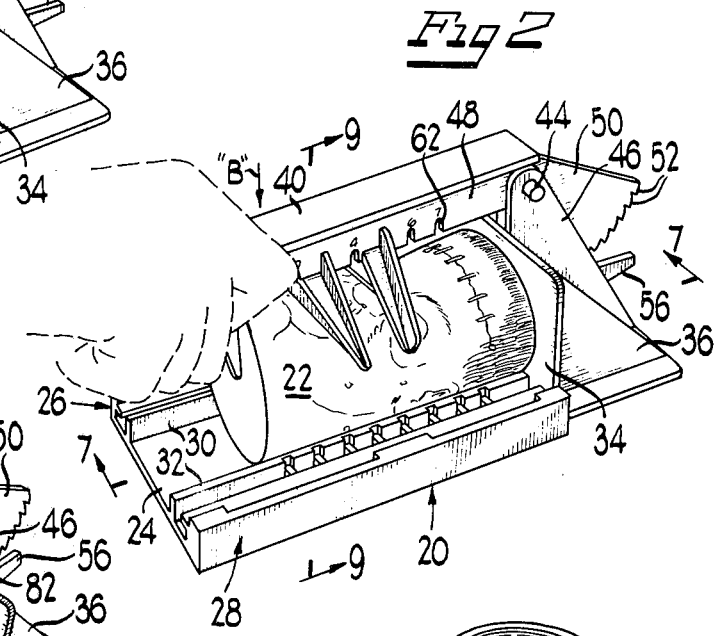
Fig 2
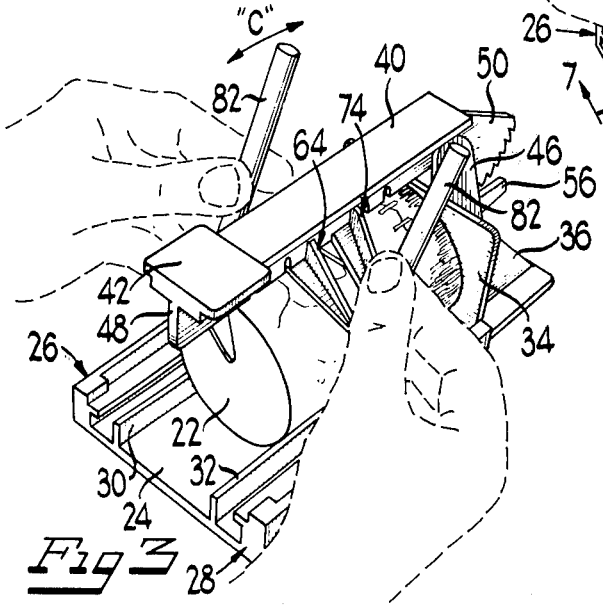
Fig 3
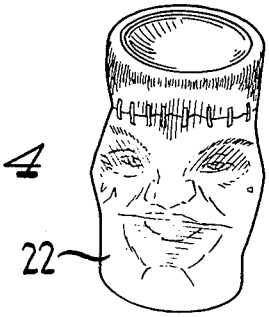
Fig 4
Fig 5
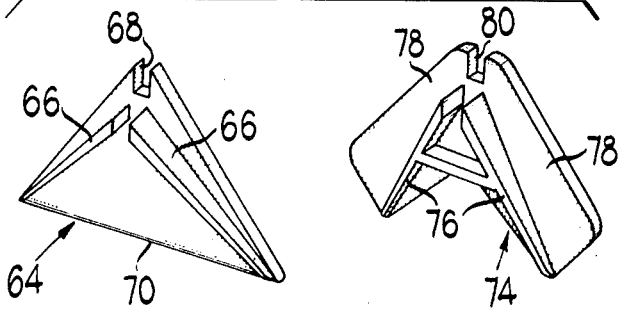
Fig 6
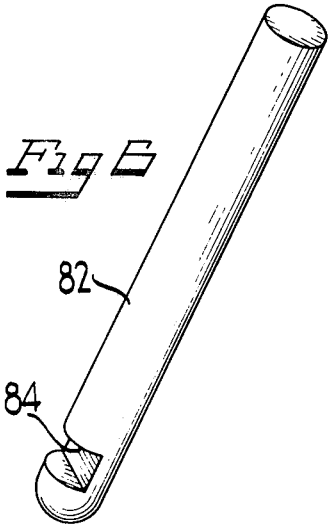

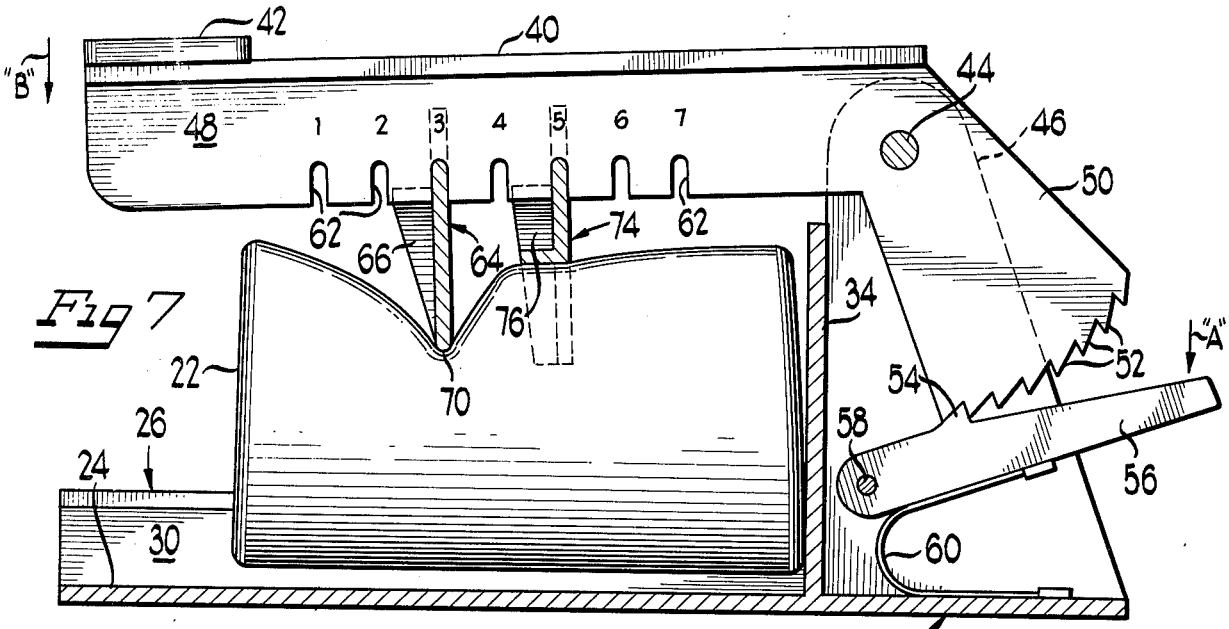
Fig 7
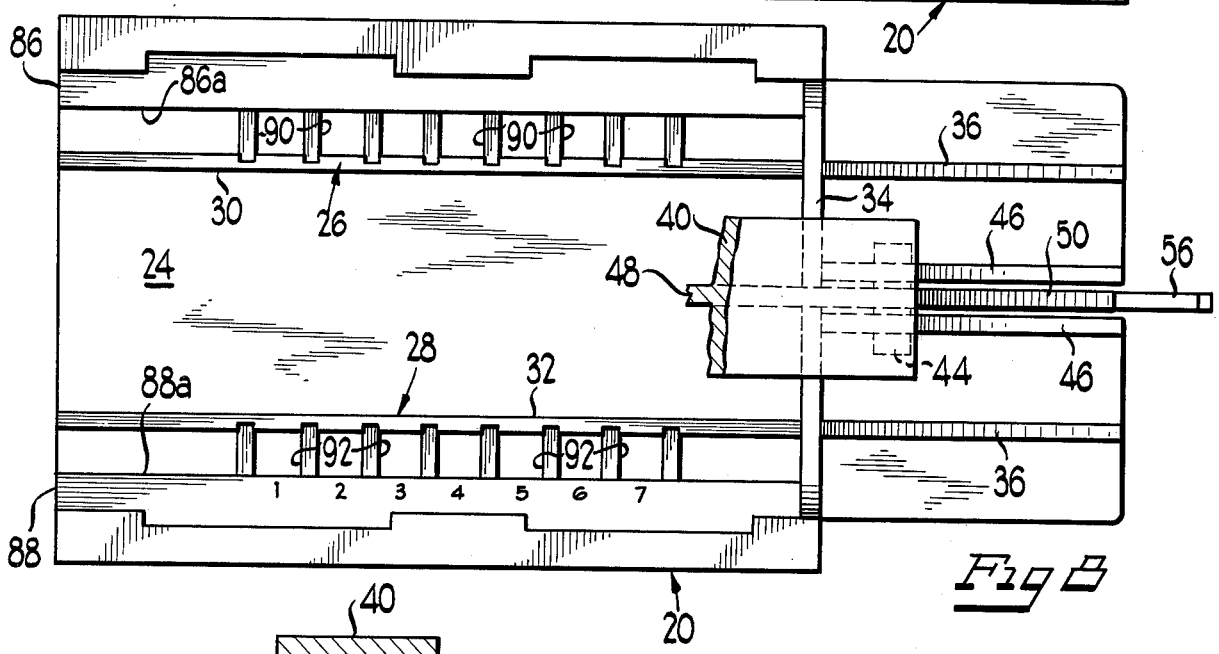
Fig 8
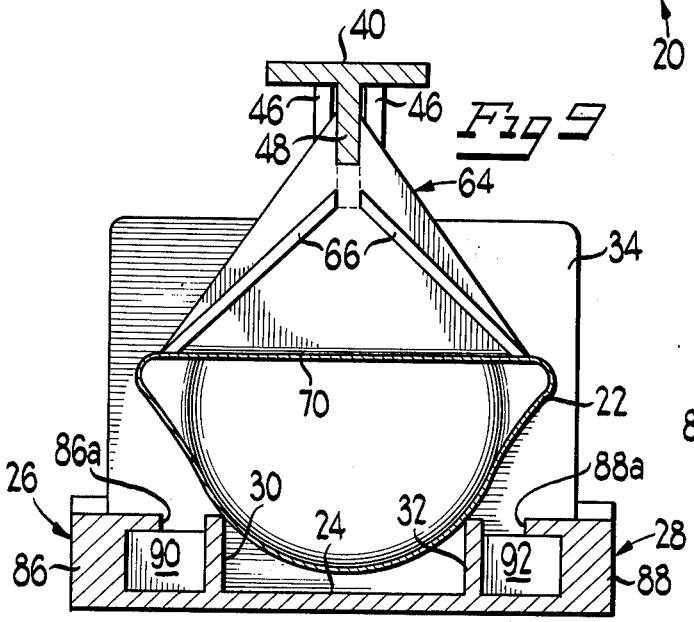
Fig 9
Fig 10
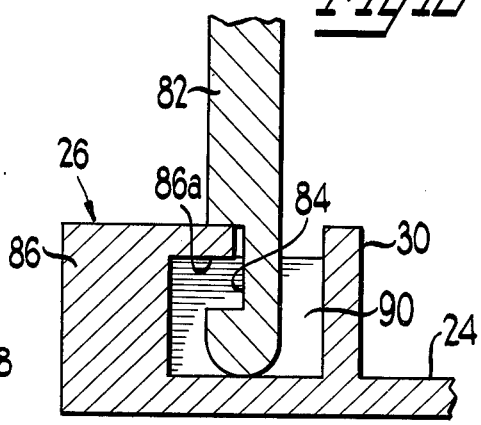

CRAFT DEVICE FOR DECORATIVELY DEFORMING METAL CANS AND THE LIKE

BACKGROUND OF THE INVENTION

A. Field of the Invention

The invention relates generally to art and craft devices and in particular to a craft device for use in decoratively deforming metal cans and the like.

B. Description of the Prior Art

Heretofore, metal cans available in the household and cylindrical ice cream cartons and the like, have been used in providing a decorative base structure for a variety of decorative craft objects. However, many such decorative efforts have been limited to merely applying a decorative design, a decal or other label or indicia onto the surface of the can or ice cream carton without physically altering or deforming the cylindrical shape of the can. Accordingly, the prior art efforts aimed at decorating cans and other cylindrical objects have been somewhat limited and the overall artistic efforts in this area have been limited to the application of surface indicia and coloring.

SUMMARY OF THE INVENTION

The present invention relates to an art and craft device, with which commonly available household metal cans and the like are decorated by physical alteration of the can surface in an almost infinite variety of ways that may be pleasing to the eye. In addition to the surface alteration in shape, decorative designs, decals, coloring and the like are applied to the deformed can surface. The device includes a base for firmly supporting a can laid on its side and at least one can deforming element is selectively engageable with an upwardly facing surface portion of the can for selectively controlled deformation of the generally cylindrical surface of the can. A lever extends longitudinally of the can and is manually pivoted toward and away from the upwardly facing surface thereof in order to deform surface portions of the can by bringing one or more can deforming elements into forceful engagement with the can surface. One or more can deforming elements of different shapes are detachably secured to the lever at various selected intervals longitudinally of the lever to provide a wide variety of different surface deformations and decorative effects on the can surface. In addition, the craft device includes one or more lever type deforming elements which are detachably interlocked with the base at selected locations for manipulation into deforming engagement with sides of the can for additional decorative deformation effects in the cylindrical can surface.

BRIEF DESCRIPTION OF THE DRAWINGS

FIG. 1 is a general perspective view illustrating a new and improved can deforming and decorative craft device shown with a can in place thereon ready to be deformed in a decorative manner in accordance with the features of the present invention;

FIG. 2 is a perspective view of the craft device similar to FIG. 1 graphically illustrating the device in an operation position deforming the upwardly facing surface of the can;

FIG. 3 is a perspective view similar to FIG. 2 but illustrating the craft device in another operating condition wherein can side deforming elements are in operation to selectively deform side surface portions of the can;

FIG. 4 is a front perspective view of a completed can which has been deformed and decorated in accordance with the features of the present invention to resemble a face;

FIG. 5 is a perspective view showing a pair of can deforming elements of the craft device;

FIG. 6 is an enlarged, perspective view illustrating one of the lever type deforming elements used for deforming side surfaces of a can in accordance with the present invention;

FIG. 7 is a longitudinal sectional view of the craft device taken substantially along lines 7—7 of FIG. 2;

FIG. 8 is a top plan view of the craft device shown with portions broken and in section;

FIG. 9 is a transverse cross-sectional view of the craft device taken substantially along lines 9—9 of FIG. 2; and FIG. 10 is a fragmentary transverse cross-sectional view illustrating the detachable interlocking attachment between the can side deforming elements of FIG. 6 and the support base structure of the craft device.

DESCRIPTION OF THE PREFERRED EMBODIMENT

Referring now more particulrly to the drawings, therein is illustrated a new and improved art and craft device generally indicated by the reference numeral 20 and especially designed and adapted for decoratively deforming cylindrical metal cans and the like such as a beer can 22. The craft device 20 includes a rectangular base or floor 24 having a pair of integrally formed side rail structures 26 and 28 along opposite longitudinal edges. As best shown in FIGS. 1, 2, 3, 7 and 9, the side rail structures 26 and 28 are provided with upstanding inside wall members, 30 and 32 respectively, which have upper edges adapted to bear against and support opposite lower side portions of a can 22 laid on its side in position on the base as shown. At the inner ends of the side rail structures 26 and 28, and intermediate the opposite ends of the floor 24 there is provided an upstanding stop wall 34 which extends transversely between the side rail structures and provides a stop surface for the end of the can. Preferably, the stop wall is integrally formed with the base 24 and a pair of triangular shaped stiffening gussets 36 are provided to strengthen the wall. As shown in FIG. 8, the triangular gussets 36 are aligned with the inside walls 30 and 32 of the respective side rail structures 26 and 28.

In accordance with the invention, the craft device 20 is provided with a manually operable lever 40 of T-shaped transverse cross-section and having an enlarged pressure pad 42 adjacent the outer or free end. At the opposite end, the lever 40 is pivotally secured by a pin 44 to a pair of upstanding brackets 46 disposed on opposite sides of the web portion 48 of the lever in sandwiching relation. The manually operable lever also includes a tail portion 50 extending downwardly between the spaced apart lever support brackets 46. The tail portion has an arcuate lower end formed with a plurality of ratchet teeth 52 adapted to cooperate with a single upwardly projecting tooth 54 formed on the upper edge of a pawl member 56 intermediate its ends as shown in FIG. 7. The inner end of the pawl is pivoted on a cross pin 58 extending between the brackets 46 and parallel of the lever pin 44. A U-shaped leaf spring 60 is mounted between the lower edge of the pawl and the upper surface of the floor base 24 and biases the lever in a counterclockwise direction as shown in FIG. 6 so that the pawl tooth 54 normally engages the ratchet teeth 52 on the lever tail portion 50. Engagement of the pawl tooth 54 and the ratchet teeth 52 positively prevents clockwise rotation of the lever 40 about the pivot axle 44 and in order to release the lever, the outer end of the pawl 56 is depressed downwardly as indicated by the arrow "A" until the pawl tooth 54 is clear of engagement with the ratchet teeth. The lever 40 may then be freely pivoted in a clockwise direction to a release position (FIG. 1) wherein a can 22 may be removed from the craft device and replaced with a new one.

In accordance with the present invention, the vertically disposed web portion 48 of the lever 40 is formed with a plurality of slots 62 along the lower edge and these slots are spaced apart at appropriate intervals longitudinally of the lever body. The slots are numbered for identification as shown in FIG. 7 with suitable indicia or markings placed on the web 48. Each slot is adapted to receive the upper end portion of a selected can deforming element 64 or 74. The can deforming elements are detachably mounted on the lever and each is formed with a particular shape especially adapted to provide a selected type of deformation of the upwardly facing surface portion of the can 22 in position on the craft device. When the lever is pivoted in a counterclockwise direction from the position of FIG. 1 to a can engaging, operative position of FIG. 2, the lower surfaces of the elements 64 and 74 are brought into controlled deforming engagement against the can.

As best shown in FIG. 5, the can deforming element 64 is of a generally triangular shape and includes a pair of upwardly sloping lateral stiffening flanges 66 which are spaced apart at their upper ends in order to accommodate the web portion 48 of the lever 40 when the deforming element is mounted in a selected one of the slots 62. The triangular shaped element 64 also includes a downwardly extending slot 68 at the upper end or apex in order to receive and interlock with the web portion 48 of the lever 40 and the element includes a wide, relatively straight lower edge 70 which is designed to form a wide crease or indentation in the can surface running transversely of the longitudinal axis of the can. When so formed, the crease closely resembles the mouth of a figure which the can may be decorated to represent. The depth and lateral extent of the crease in the can surface is determined by the amount of pressure applied to the pad 42 of the lever 40 and as shown in FIG. 6, when a maximum deformation is desired, the lever is depressed until the pawl tooth 54 engages the last tooth 52 in the tail portion 50 of the lever as shown. As the lever 40 is pivoted downwardly in a counterclockwise direction as indicated by the arrow "B", FIGS. 2 and 7, from the position of FIG. 1, the ratchet teeth 52 sequentially engage the single pawl tooth 54 and provide an audible clicking sound. By noting the number of clicks as the lever is depressed, the operator can determine the amount of depression that the lower edge 70 of the can deforming element 64 is making in the surface of the can and in subsequent operations, the same or different amounts of depression can be achieved by simply counting the number of clicks or by feeling the clicks, the force of which is transmitted to the lever handle as each successive tooth 52 engages the single pawl tooth 54.

The can deforming element 74 has an inverted, V-shaped profile and is adapted to deform an upwardly facing surface of the can 22 in a manner whereby a pair of laterally spaced apart identations or depressions are made. These depressions can resemble the eyes of the face on the finished object as shown best in FIG. 4. The element 74 includes a pair of downwardly and outwardly diverging flange portions 76 which taper in width from a maximum adjacent their upper ends to a minimum width adjacent their lower ends as best shown in dotted lines in FIG. 7. These flange portions are stiffened by a pair of web portions 78 which converge adjacent the upper end portion of the element and a slot 80 is provided to accommodate the web 48 of the actuating lever 40. The upper ends of the divergent flanges 76 are spaced apart as shown in FIG. 5 to accommodate the web 48 of the actuating lever.

As shown in FIG. 1, the can deforming element 64 may be inserted in slot number 3 on the lever web 48 while the can deforming element 74 may be inserted in slot number 5 in order to achieve a particularly desired spacing distance between the indentations forming the eyes and the mouth of the face as shown in FIG. 4. Other variations in spacing can be utilized with resultant changes in the appearance of the finished article. In addition, the size of the deformations or indentations can be varied and controlled by varying the depth of penetration of the deforming elements into the can surface. This depth can be monitored by utilizing the sound and feel of the ratchet teeth and pawl as the lever 40 is being actuated. Once the desired amount of can deformation is achieved, engagement between one of the ratchet teeth 52 and the pawl tooth 54 locks the lever 40 in the position shown in FIG. 3.

With the can thus held in position, additional selective deformation of the opposite side surfaces of the can may be achieved by means of a pair of lever type, can deforming elements or rods 82 as best shown in FIG. 6. The lever type deforming rods 82 comprise elongated members which are rounded at their lower ends and the lower end portions are formed with a transverse slot 84 spaced a short distance upwardly of the lower end. The lower end portions of the rods are adapted to be detachably engageable with the respective left and right side base rail structures 26 and 28 and these rods may be manually pivoted in a direction longitudinally of the can body as indicated by the arrow "C" in FIG. 3, and are pivotal laterally toward and away from the adjacent can sides to effect the desired deformation of the can surface structure. As shown in FIG. 3, both hands may be used to manipulate the levers 82 on opposite sides of the can while the partially deformed can is positively held in locked engagement on the base structure on the craft device 20 by the locked lever 40. The can sides may be deformed inwardly or can be made to bulge outwardly as shown in FIG. 4 by selective manipulation of the side deforming rods 82. The combination of can deformation action achieved with the lever controlled elements 64 and 74, and with the side deforming rods 82 provides an almost infinite variety of artistic shapes and configurations for a common can 22.

As best shown in FIGS. 8, 9 and 10, the respective side rail structures 26 and 28 of the base of the craft device 20 are formed with relatively thick outer opposite side walls 86 and 88 respectively, which walls are spaced from the respective inner side walls 30 and 32 to provide a pair of open channel-like longitudinal recesses for receiving the lower end portions of the rods 82 as shown in FIG. 10. The outer side walls 86 and 88 are formed with integral inturned flanges along the upper edges designated **86*a* and 88*a* respectively, to provide retaining lips for holding engagement with the slots 84** of the rods 82 to permit pivotal movement of the rods into deforming engagement with the sides of the can 22. In order to guide the selective positioning of the can side deforming rods 82 on the base 24, the open channels in the side rail structures are divided longitudinally into a plurality of separate rod end receiving pockets as best shown in FIG. 8. These pockets are numbered and are separated from one another by integrally formed divider walls 90 and 92 respectively.

A can 22 may be decorated with painting, decals or other indicia before or after it is deformed in the craft device 20 and in either event, a wide variety of decorative and artistic treatments can be achieved with a commonly available metal can such as a beer can or the like. The craft device 20 provides a conveniently operable means whereby an unskilled person can produce a wide variety of designs and shapes and in addition, these designs may be produced repetatively if a number of identical designs are desired.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent of the U.S. is:

1. Apparatus for decoratively deforming cylindrical metal cans comprising:

a base for supporting a can laid on its side, a pair of can deforming elements selectively engageable with an upwardly facing surface portion of said can laid in position on said base, one of said deforming elements including an edge for engaging a can at a highest area on said upwardly facing surface portion, and the other of said deforming elements including a pair of edges angularly disposed to one another for engaging said upwardly facing surface portion of said can at spaced apart lower areas on opposite sides of said highest area.

lever means extending longitudinally of said can and pivotally mounted on said base adjacent one end thereof for manual pivotal movement toward and away from said upwardly facing portion of said can, and means for detachably supporting said can deforming elements for controlled deforming engagement against said can surface at selected one of a plurality of longitudinally spaced apart locations on said lever means.

2. The apparatus of claim 1 wherein said means for detachably supporting said can deforming element includes interlocking portions of said can deforming element and said lever means for securing said element at a selected one of a plurality of positions at spaced intervals longitudinally on said lever means.

3. The apparatus of claim 1 wherein said lever means is pivotally supported adjacent one end about a lateral pivot axis transverse to the longitudinal axis of said can when laid on its side on said base.

4. The apparatus of claim 1 wherein said base includes a pair of spaced apart side rails for supportively engaging spaced apart longitudinally extending surface portions on the underside of said can.

5. The apparatus of claim 4 wherein said base includes a stop surface extending transversely between said side rails for engaging an end of said can.

6. The apparatus of claim 4 wherein said side rails are spaced apart from opposite sides of said lever means.

7. The apparatus of claim 1 including locking means for positively retaining said element in a position wherein said element is in deforming engagement with said can.

8. The apparatus of claim 7 wherein said locking means includes a plurality of ratchet teeth and a pawl yieldingly biased into engagement with said teeth.

9. The apparatus of claim 7 wherein said locking means operatively interconnects said base and said lever for holding said lever in a selected position relative to said base.

10. The apparatus of claim 9 wherein said locking means is manually releasable to permit free pivotal movement of said lever away from said can laid on said base.

11. Apparatus for decoratively deforming cylindrical metal cans comprising:

a base for supporting a can laid on its side, at least one can deforming element selectively engageable with an upwardly facing surface portion of said can laid in position on said base, lever means extending longitudinally of said can and manually pivotal toward and away from said upwardly facing portion of said can for detachably supporting said can deforming element for controlled deforming engagement against said can surface, and at least one secondary can deforming element having a lower end pivotally supported on said base and including an upper portion manually movable toward and away from said lever means for controlled deforming engagement against said can.

12. The apparatus of claim 11 including a plurality of said secondary can deforming elements and means for detachably interlocking the lower ends of said secondary elements at spaced intervals longitudinally of said can with said base.

* * * * *